US009776204B2

(12) United States Patent
Hung

(10) Patent No.: US 9,776,204 B2
(45) **Date of Patent: *Oct. 3, 2017**

(54) PUSH MEMBER AND CAULKING GUN HAVING THE SAME

(71) Applicant: SIANG SYUAN FU ENTERPRISE CO., LTD., Hemei Township, Changhua County (TW)

(72) Inventor: Hung-Chih Hung, Hemei Township, Changhua County (TW)

(73) Assignee: Siang Syuan Fu Enterprise Co., Ltd., Hemei Township, Changhua County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/047,088

(22) Filed: Feb. 18, 2016

(65) Prior Publication Data

US 2016/0288162 A1 Oct. 6, 2016

(30) Foreign Application Priority Data

Apr. 2, 2015 (TW) ..... 104110791 A

(51) Int. Cl.
*B05C 17/01* (2006.01)
*B05C 17/005* (2006.01)

(52) U.S. Cl.
CPC .. *B05C 17/00576* (2013.01); *B05C 17/00533* (2013.01); *B05C 17/00583* (2013.01); *B05C 17/00596* (2013.01); *B05C 17/01* (2013.01); *B05C 17/0123* (2013.01)

(58) Field of Classification Search
CPC ..... B05C 17/005; B05C 17/00533; B05C 17/00543; B05C 17/00576; B05C 17/01; B05C 17/0103; B05C 17/012; B05C 17/015; B05C 17/0116; B05C 17/00596
USPC ..... 92/187, 188
See application file for complete search history.

(56) References Cited

U.S. PATENT DOCUMENTS 2,387,106 A * 10/1945 Allen ..... E21B 33/062 251/1.3
2,786,604 A * 3/1957 Collins ..... B05C 17/0123 222/327
3,188,057 A * 6/1965 Trumbull ..... B01F 11/0054 222/229
4,311,258 A * 1/1982 Bradshaw ..... B05C 17/00576 141/383

(Continued)

FOREIGN PATENT DOCUMENTS

JP 04200672 A * 7/1992 ..... B05C 17/00576

*Primary Examiner* — Patrick M Buechner
(74) *Attorney, Agent, or Firm* — Muncy, Geissler, Olds & Lowe, P.C.

(57) ABSTRACT

A push member and a caulking gun having the same. The caulking gun includes the push member, a gun body and a push rod. The push member includes a blockable receiving portion which includes a receiving space and a lip protruding from a periphery of the receiving space, and a push portion arranged opposite to the blockable receiving portion in a first direction, for pushing a caulk cartridge. The lip defines a blocking mouth, and the blocking mouth and the receiving space are open toward a same lateral side of the push member to form an open end. When a push plate of the push rod is disposed within the receiving space, the lip and the push plate are blockable with each other in the first direction.

10 Claims, 8 Drawing Sheets

(56) References Cited

U.S. PATENT DOCUMENTS

| | | | | |
|---|---|---|---|---|
| 4,678,107 | A * | 7/1987 | Ennis, III | A61M 5/31511 222/386.5 |
| 4,840,293 | A * | 6/1989 | Segatz | B05C 17/00576 222/326 |
| 6,178,873 | B1 * | 1/2001 | Pierobon | F04B 39/0005 92/187 |
| 9,630,204 | B2 * | 4/2017 | Hung | B05C 17/01 |
| 2003/0116590 | A1 * | 6/2003 | Lord | B05C 17/002 222/389 |
| 2009/0020561 | A1 * | 1/2009 | Keller | B05C 17/00553 222/137 |
| 2016/0310983 | A1 * | 10/2016 | Hung | B05C 17/00576 |

* cited by examiner

PUSH MEMBER AND CAULKING GUN HAVING THE SAME

BACKGROUND OF THE INVENTION

Field of the Invention

The present invention relates to a push member and caulking gun having the same.

Description of the Prior Art

Referring to FIG. 1, a conventional caulking gun includes a gun body 10, a limitation member 11, an elastic mechanism 12 and a support body 13. The limitation member 11 is attached to the gun body 10. The gun body 10 includes a push rod 14 disposed through the elastic mechanism 12 and the support body 13. An end of the push rod 14 is provided with a push member for extruding caulking out from the caulk cartridge. The push member is attached to the push rod 14 and includes a round plate 15 and a round pad 16. The round pad 16 is fixed to the push rod 14 by using a nut 17. The conventional caulking gun has disadvantages as follows: (1) it requires tools to assemble the round plate 15 and the round pad 16 to the push rod 14, and the nut 17 is too small to be installed, thus being inconvenient; and (2) the round pad 16 is generally made of plastic (such as ABS, PP, PE), and the nut 17 can damage the round pad 16, thus resulting in that the caulking cannot be extruded out from the caulk cartridge.

The present invention is, therefore, arisen to obviate or at least mitigate the above mentioned disadvantages.

SUMMARY OF THE INVENTION

An object of the present invention is to provide a push member and caulking gun having the same, in which a push member may be optionally manually assembled to a push plate in accordance with use of a caulk cartridge with a soft-housing or a caulk cartridge with a hard-housing, thus being easy and quick.

To achieve the above and other objects, a push member for a caulking gun is provided, for being assembled to a push plate at a front end portion of a push rod of the caulking gun, including: a blockable receiving portion, including a receiving space and a lip protruding from a periphery of the receiving space, the lip defining a blocking mouth, the blocking mouth and the receiving space open toward a same lateral side of the push member to form an open end; a push portion, arranged opposite to the blockable receiving portion in a first direction, for pushing a caulk cartridge disposed on the caulking gun; wherein when the push plate is disposed within the receiving space, the first direction is substantially parallel to a longitudinal direction of the push rod, the front end portion of the push rod is disposed within the blocking mouth, and the lip and the push plate are blockable with each other in the first direction.

To achieve the above and other objects, a caulking gun is provided, including the push member and a push rod, and further including: a gun body, for installation of a caulk cartridge; a push rod, movably attached to the gun body, provided with a push plate at a front end portion thereof.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
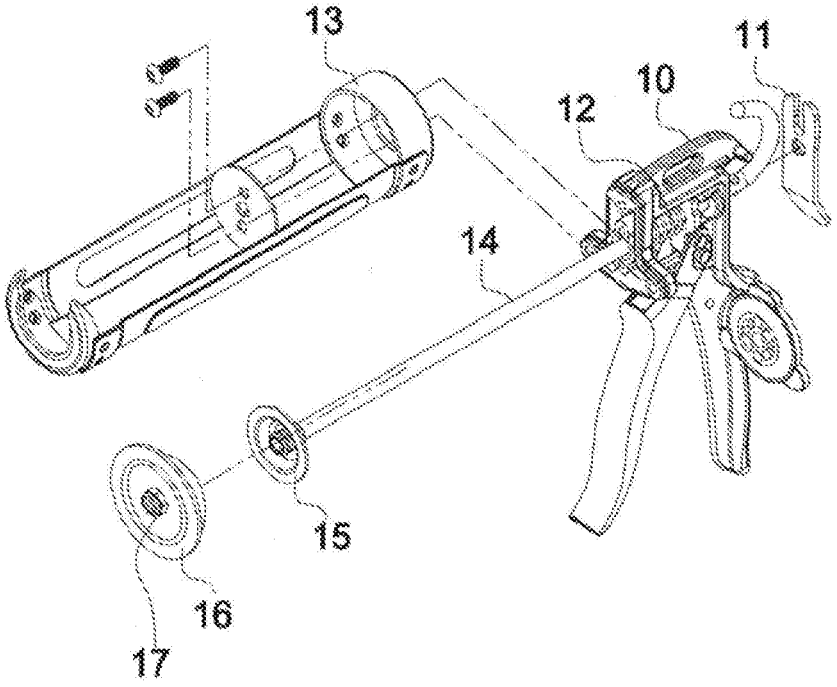
FIG. 1 PRIOR ART
FIG. 1 is a drawing showing a conventional caulking gun.
Figure 2:
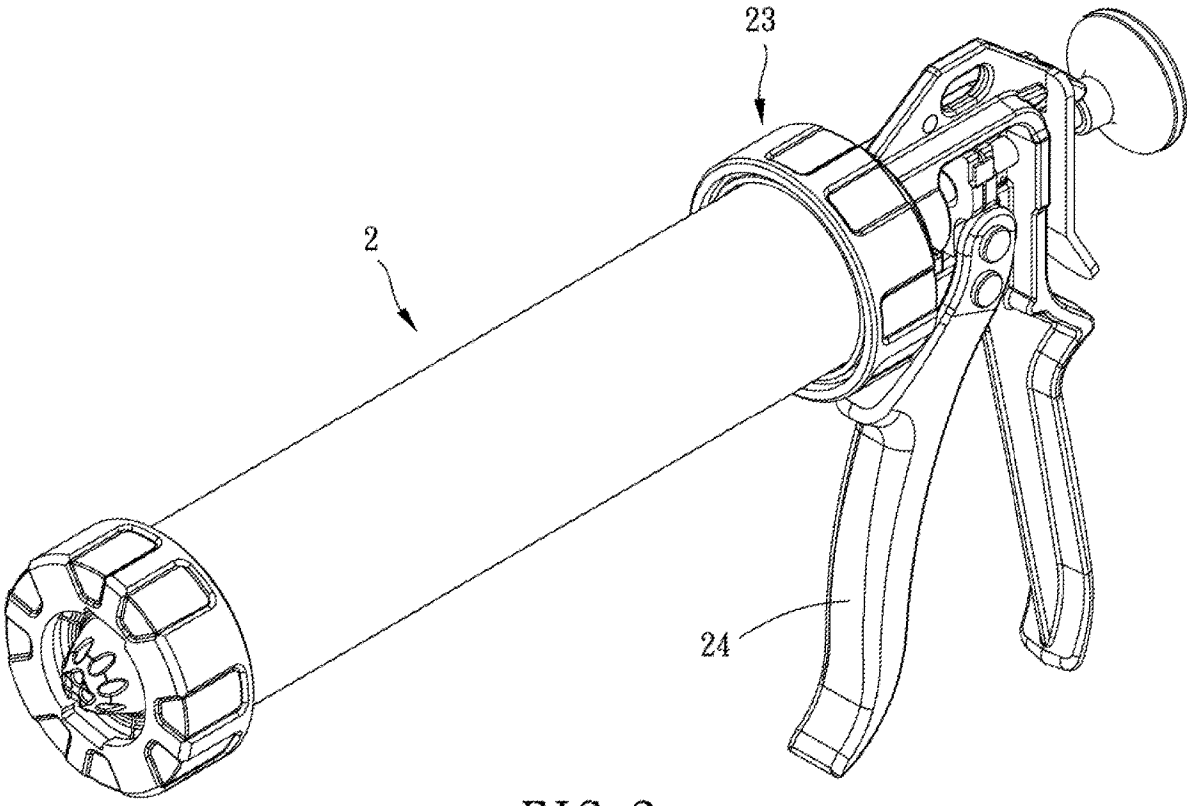
FIG. 2 is a perspective view of a preferred embodiment of the present invention.
Figure 3:
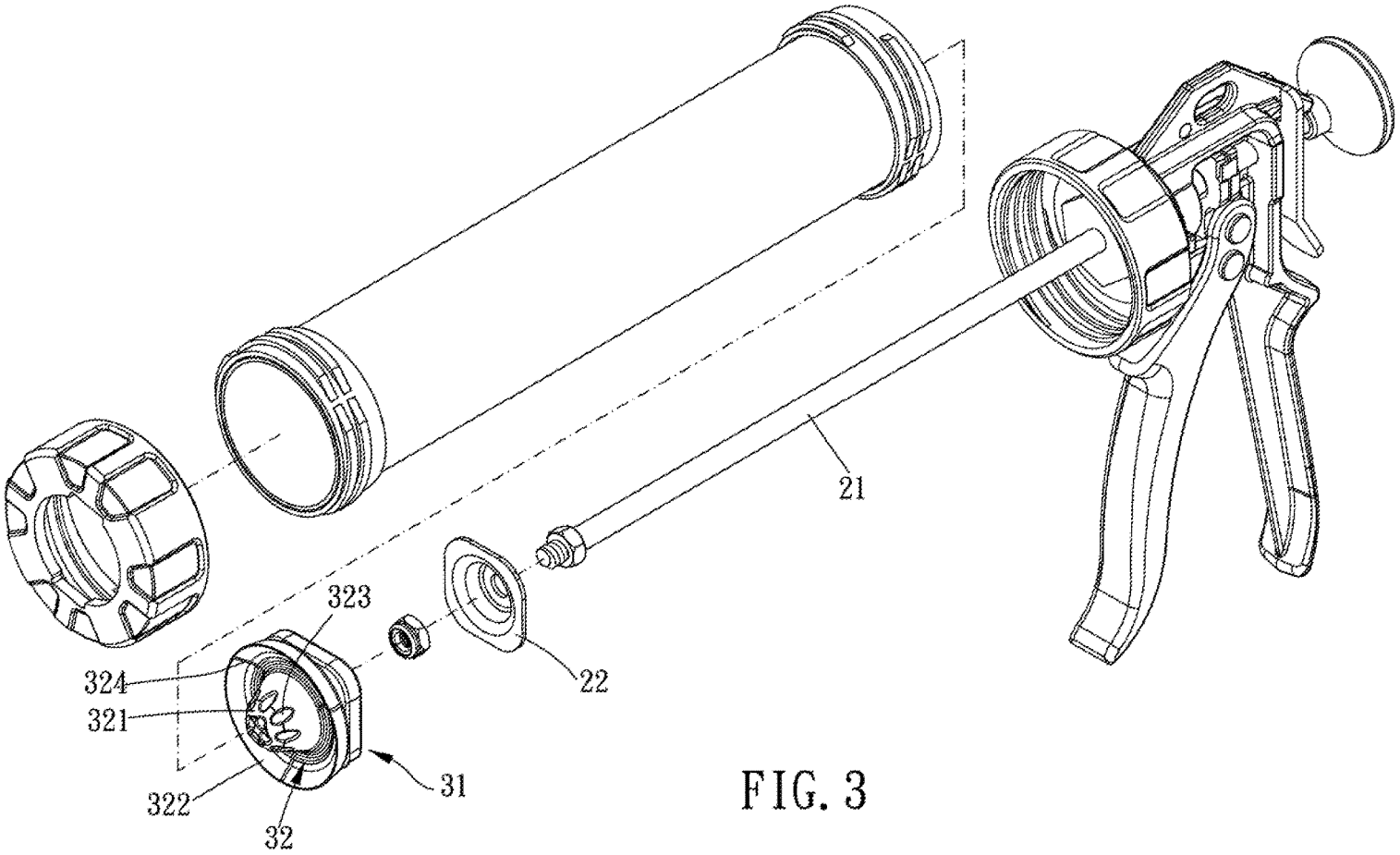
FIG. 3 is an explosion drawing of a preferred embodiment of the present invention.
Figure 4:
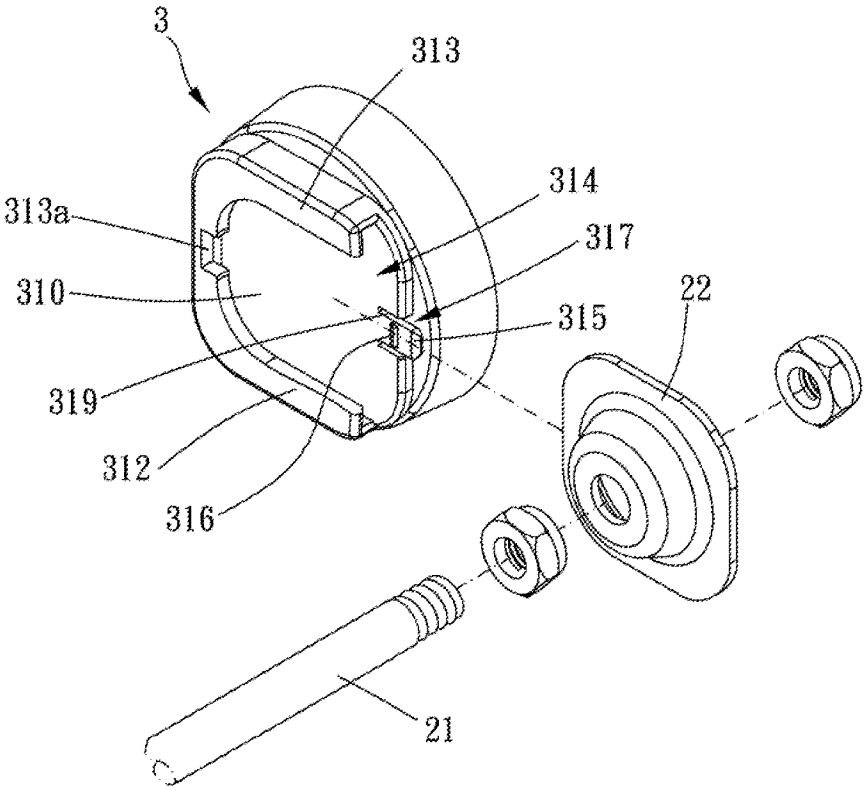
FIG. 4 is a partial view of a preferred embodiment of the present invention.

FIGS. 2-5A and 5B show a push member 3 and caulking gun 2 having the same according to a preferred embodiment of the present invention. The push member 3 is for being assembled to a push plate 22 at a front end portion of a push rod 21 of the caulking gun 2, and the push member 3 includes a blockable receiving portion 31 and a push portion 32.

The blockable receiving portion 31 includes a receiving space 311 and a lip 312 protruding from a periphery of the receiving space 311, and the lip 312 is U-shaped and has a L-shaped cross-section. The lip 312 defines a blocking mouth 313 which contracts relative to the receiving space 311, and the lip 312 has at least one breach 313*a* communicating with the blocking mouth 313. The blocking mouth 313 and the receiving space 311 open toward a same lateral side of the push member 3 to form an open end 314 through which the push plate 22 is inserted into the receiving space 311, thus allowing required deformation. The push portion 32 is arranged opposite to the blockable receiving portion 31 in a first direction, for pushing a caulk cartridge disposed on the caulking gun 2. When the push plate 22 is disposed within the receiving space 311, the first direction is substantially parallel to a longitudinal direction of the push rod 21, the front end portion of the push rod 21 is disposed within the blocking mouth 313, and the lip 312 and the push plate 22 are blockable with each other in the first direction. Whereby, it is optional to assemble the push member 3 onto the push plate 22 when a caulk cartridge with a soft-housing is used, or not to assemble the push member 3 onto the push plate 22 when a caulk cartridge with a hard-housing is used. It is noted that the push member 3 and the push plate 22 can be disassembled from each other manually without any tools.

Preferably, the blockable receiving portion 31 further includes a blocking member 315 disposed at the open end 314, and the blocking member 315 includes at least one protrusion 316 projecting in a direction away from the push portion 32. The at least one protrusion 316 and the push plate 22 which is received in the receiving space 311 are blockable with each other at the lateral side, thus avoiding detachment of the push plate 22. The blockable receiving portion 31 includes a gap 317 relatively under the blocking member 315 and opposite to the open end 314. Specifically, an annular groove 318 is provided between the blockable receiving portion 31 and the push portion 32, and the gap 317 may be a part of the annular groove 318. As viewed in the first direction, the blocking member 315 is provided with two notches 319 at two opposite sides thereof, so that the blocking member 315 is deformable to allow the push plate 22 to come into or out from the receiving space 311. The blockable receiving portion 31 may further include an abutting face 310 on a bottom of the receiving space 311, and a middle portion of the abutting face 310 may be concave toward the blockable receiving portion 31. The abutting face 310 is for pushing the push plate 22, and the middle portion of the abutting face 310 which is concave can provide a room for the front end of the push rod 21 (such as a nut for fastening the push plate) without interference.

Figure 7:
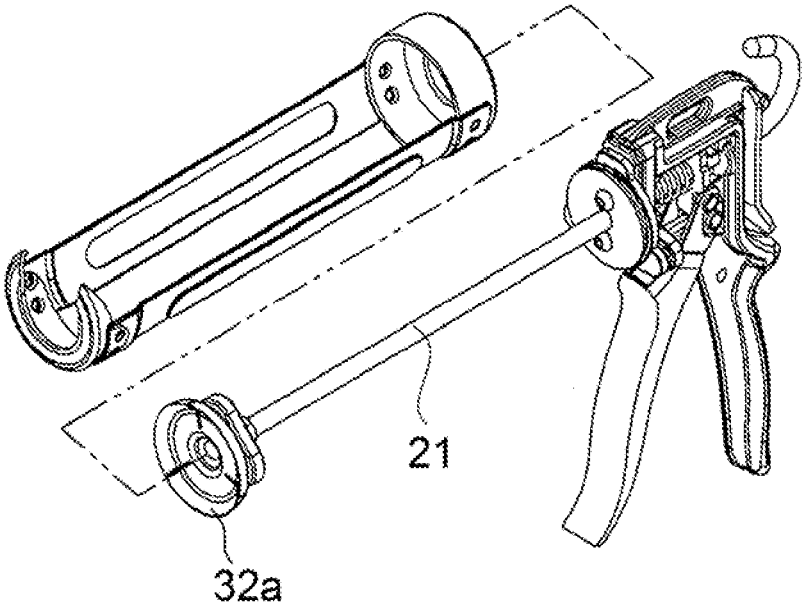
FIG. 7 is a drawing showing another preferred embodiment of the present invention.
Figure 8:
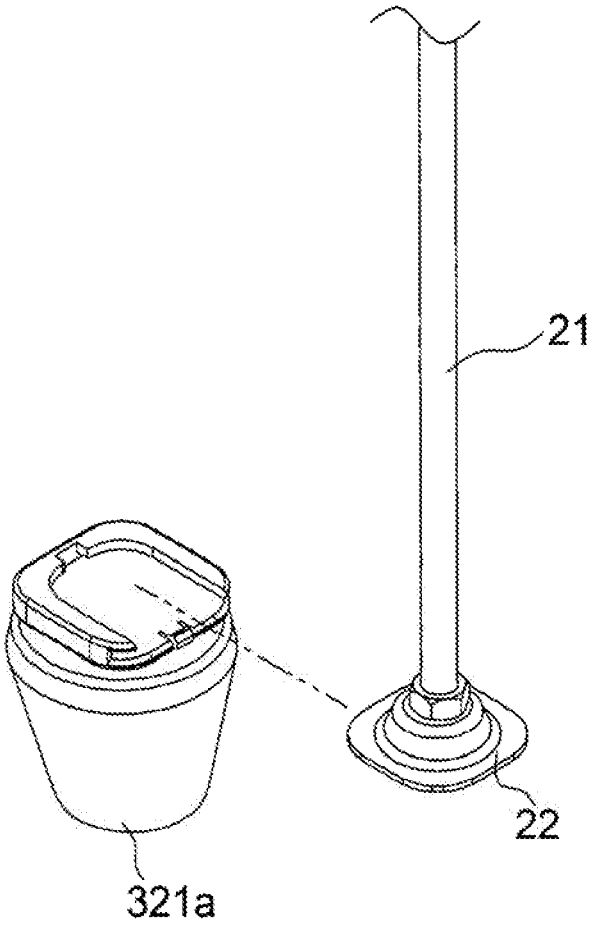
FIG. 8 is a drawing showing an alternative preferred embodiment of the present invention.

The push portion 32 includes a push head 321 and a concave face 322 around the push head 321. The push head 321 is provided with a plurality of holes 323, and the concave face 322 is radially provided with a plurality of slits 324. Specifically, the push head 321 is provided with the plurality of holes 323 extending in the first direction, and the plurality of slits 324 communicate with the annular groove 318 and are open at an edge of the concave face 322. The push portion 32 further includes a material-reduced portion 325 annularly disposed between the push head 321 and the push head 321 (such as an annular groove). As viewed in a direction perpendicular to the first direction, openings of the holes 323 of the push head 321 are located beyond the edge of the concave face 322. With the plurality of holes 323 the push portion 32 is lightened and has little shrinking deformation. The plurality of slits 324 and the material-reduced portion 325 allow some deformation of the push portion 32, for being adapted to various caulking guns or caulk cartridges. The middle portion of the push portion 32*a* may be provided with a recession (FIG. 7); or the push head 321*a* may be conical (FIG. 8).

A caulking gun 2 is also provided. The caulking gun 2 includes a push member 3 mentioned above, a gun body 23 and a push rod 21. The gun body 23 is for installation of a caulk cartridge 5, the push rod 21 is movably attached to the gun body 23, and a front end of the push rod 21 is provided with a push plate 22 for pushing the caulk cartridge 5. In use, every press of a lever 24 pivoted to an distal end of the gun body 23 operates to move the push rod 21 forward so that the push plate 22 pushes the caulk cartridge 5 and the caulk in the caulk cartridge 5 is extruded out. It is noted that in an alternative embodiment a push rod may be actuated by power mechanism and the lever is not required.

Figure 5A:
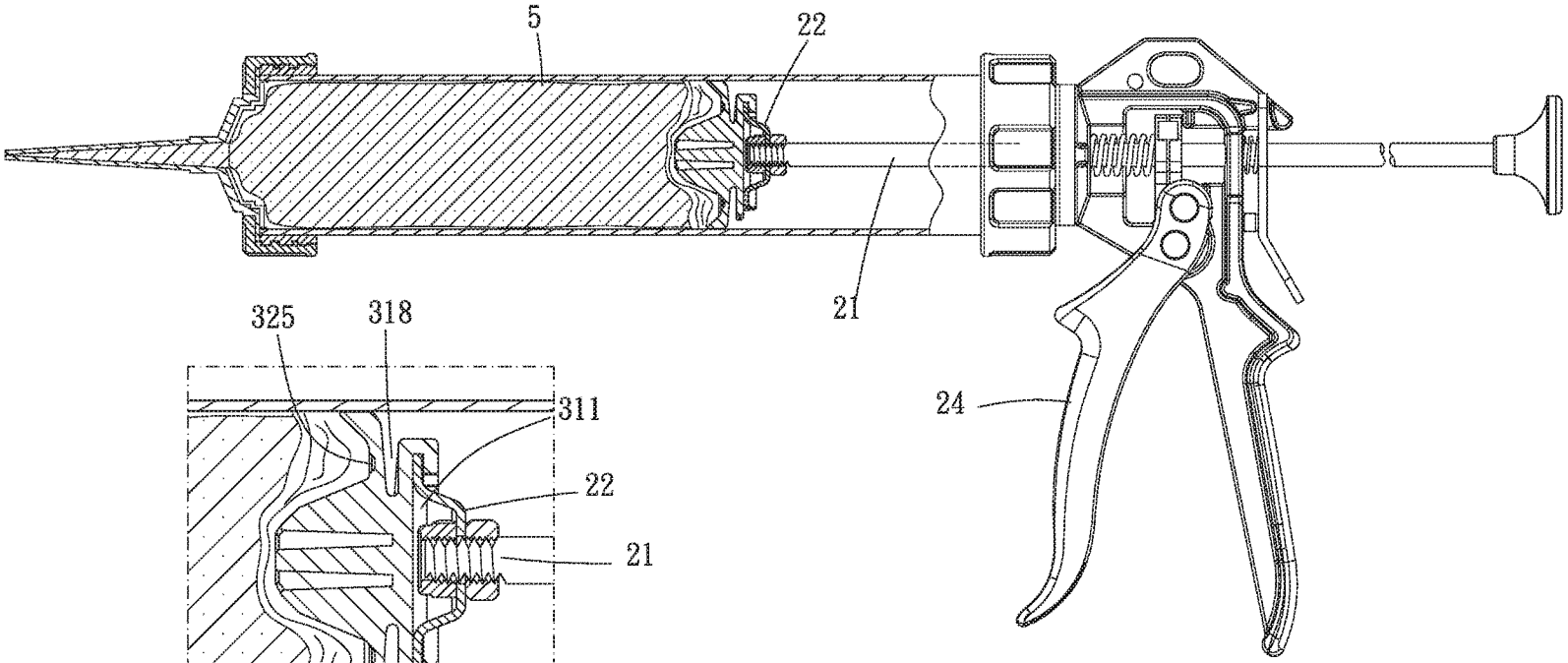
FIG. 5A is a drawings showing a preferred embodiments of the present invention in use.
Figure 5B:
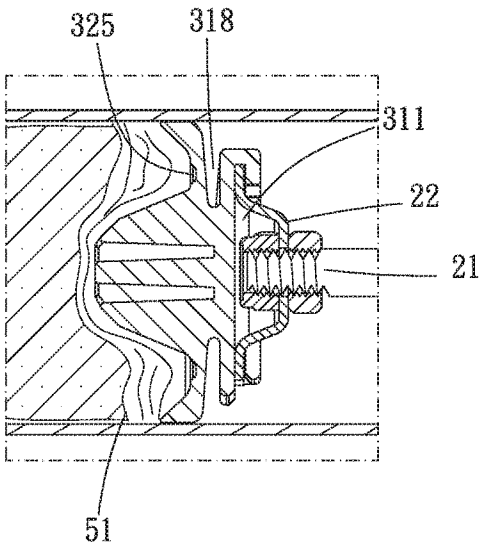
FIG. 5B is a partial enlarged view of FIG. 5A.
Figure 6A:
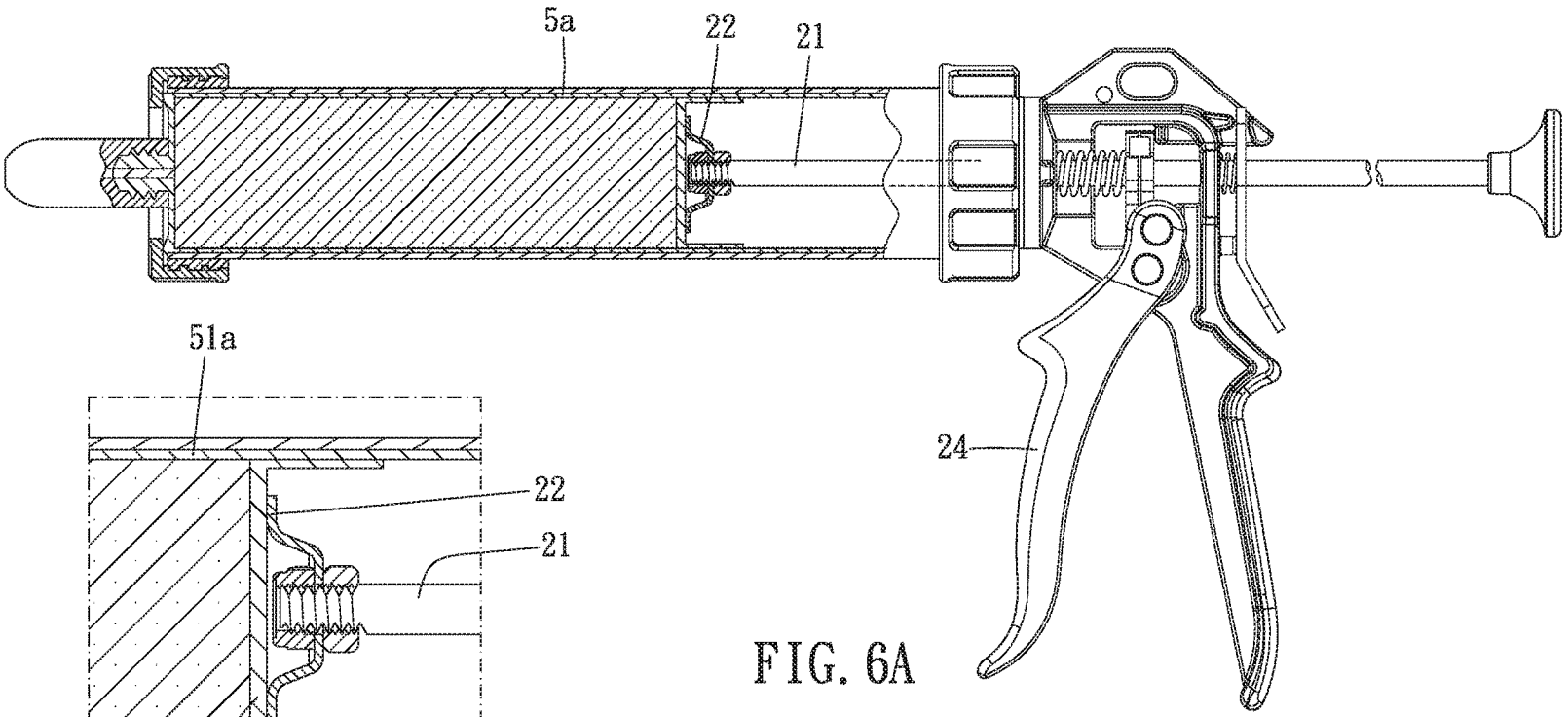
FIG. 6A is a drawing showing another preferred embodiment of the present invention in use.
Figure 6B:
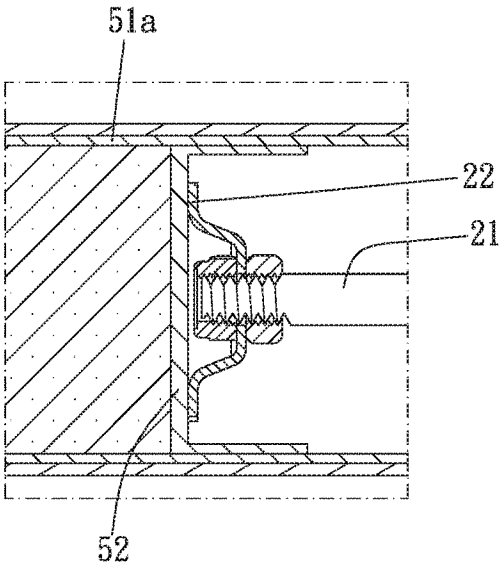
FIG. 6B is a partial enlarged view of FIG. 6A.

When the caulk cartridge 5*a* is provided with a hard-housing 51*a*, the hard-housing 51*a* is substantially not deformable, the push plate 22 can be used without the push member 3 to push the piston 52 to extrude the caulking out from the caulk cartridge 5*a* (FIGS. 6A and 6B). When the caulk cartridge 5 is provided with a soft-housing 51 which is deformable, the push member 3 is manually assembled to the push plate 22 so that the push portion 32 of the push member 3 can match the receiving room of the gun body 23 in size, and thus the caulking can be extruded out from the caulk cartridge 5 (FIG. 5A).

Given the above, the push member of the present may be optionally manually assembled to the push plate depending on use of a caulk cartridge with a soft-housing or a caulk cartridge with a hard-housing. The application is easy and quick.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A push member for a caulking gun, for being assembled to a push plate at a front end portion of a push rod of the caulking gun, including:

a blockable receiving portion, including a receiving space and a lip protruding from a periphery of the receiving space, the lip defining a blocking mouth, the blocking mouth and the receiving space open toward a same lateral side of the push member to form an open end;

a push portion, arranged opposite to the blockable receiving portion in a first direction, for pushing a caulk cartridge disposed on the caulking gun;

wherein when the push plate is disposed within the receiving space, the first direction is substantially parallel to a longitudinal direction of the push rod, the front end portion of the push rod is disposed within the blocking mouth, and the lip and the push plate are blockable with each other in the first direction.

2. The push member of claim 1, wherein the blockable receiving portion further includes a blocking member disposed at the open end, the blocking member includes at least one protrusion projecting in a direction away from the push portion, and the at least one protrusion and the push plate which is received in the receiving space are blockable with each other at the lateral side.

3. The push member of claim 1, wherein the blockable receiving portion includes a gap relatively under the blocking member and opposite to the open end, and as viewed in the first direction, the blocking member is provided with two notches at two opposite sides thereof.

4. The push member of claim 1, wherein an annular groove is provided between the blockable receiving portion and the push portion.

5. The push member of claim 1, wherein the blockable receiving portion further includes an abutting face on a bottom of the receiving space, and a middle portion of the abutting face is concave toward the blockable receiving portion.

6. The push member of claim 1, wherein the push portion includes a push head and a concave face around the push head.

7. The push member of claim 6, wherein the push head is further provided with a plurality of holes.

8. The push member of claim 6, wherein the concave face is radially provided with a plurality of slits.

9. The push member of claim 6, wherein the lip is U-shaped and provided with at least one breach communicating with the blocking mouth, an annular groove is provided between the blockable receiving portion and the push portion, the blocking member includes at least one protrusion projecting in a direction away from the push portion, the at least one protrusion and the push plate which is received in the receiving space are blockable with each other at the lateral side, as viewed in the first direction, the blocking member is provided with two notches at two opposite sides thereof, the push head is further provided with a plurality of holes extending in the first direction, the concave face is radially provided with a plurality of slits which communicate with the annular groove and are open at an edge of the concave face, the push portion further includes a material-reduced portion annularly disposed between the push head and the push head, as viewed in a direction perpendicular to the first direction, openings of the holes of the push head are located beyond the edge of the concave face.

10. A caulking gun, including the push member of claim 1, further including:

a gun body, for installation of a caulk cartridge;

a push rod, movably attached to the gun body, provided with a push plate at a front end portion thereof.

* * * * *